United States Patent [19]

Norton

[11] Patent Number: 4,913,076

[45] Date of Patent: Apr. 3, 1990

[54] ANCHOR DAVIT ASSEMBLIES

[75] Inventor: Don S. Norton, Clinton, Miss.

[73] Assignee: Brell Mar Products, Inc., Jackson, Miss.

[21] Appl. No.: 215,995

[22] Filed: Jun. 21, 1988

[51] Int. Cl.[4] ..... B63B 21/22

[52] U.S. Cl. ..... 114/210; 254/368; 24/599

[58] Field of Search ..... 254/365, 368, 376; 24/270, 69 T, 599; 114/210, 254, 293; 242/86.5 A, 156

[56] References Cited

U.S. PATENT DOCUMENTS

| | | | |
|---|---|---|---|
| 2,831,450 | 4/1958 | Schiele | 114/210 |
| 2,837,050 | 6/1958 | Frank | 114/210 |
| 2,893,341 | 7/1959 | Anderson | 114/210 |
| 2,954,004 | 9/1960 | Evans, Jr. | 114/210 |
| 3,097,410 | 7/1963 | Lincoln | 24/270 |
| 3,201,092 | 8/1965 | Skraban | 254/368 |
| 3,220,701 | 11/1965 | Clausen et al. | 254/368 |
| 3,804,051 | 4/1974 | Norton | 114/210 |

FOREIGN PATENT DOCUMENTS

| | | | |
|---|---|---|---|
| 244073 | 2/1963 | Australia | 254/368 |

*Primary Examiner*—Joseph F. Peters, Jr.
*Assistant Examiner*—Edwin L. Swinehart
*Attorney, Agent, or Firm*—Nixon & Vanderhye

[57] ABSTRACT

An anchor davit assembly preferably includes an anchor support bracket and a winch. The bracket is provided with a releasable locking system to positionally lock the anchor to the anchor support bracket, the locking system including a lever which is pivotally connected at one end to the anchor support bracket, and a tension spring (or other suitable biasing structure) which connects the anchor to the lever. The tension spring thus urges the anchor rearwardly against the anchor support bracket while also urging the lever to pivot in a direction towards its locked position. The winch of the invention includes a spool freely rotatable about an axle and a handle pivotally connected to one of the axle's ends. The axle is, in turn, mounted for rotation relative to a base support. Clutch structure is provided which, in essence, establishes a substantially rigid union between the spool and the axle when the handle is in an engaged position so that the spool and axle are capable of rotation as a unit relative to the base support thereby allowing the anchor to be hoisted. The substantially rigid union between the spool and axle is terminated when the handle is moved to its released position thus allowing free rotation of the former about the latter and thereby allowing line to be payed out from the spool. Control over the rate of line pay out is effected by moving the handle to a position intermediate its released and engaged positions.

31 Claims, 3 Drawing Sheets

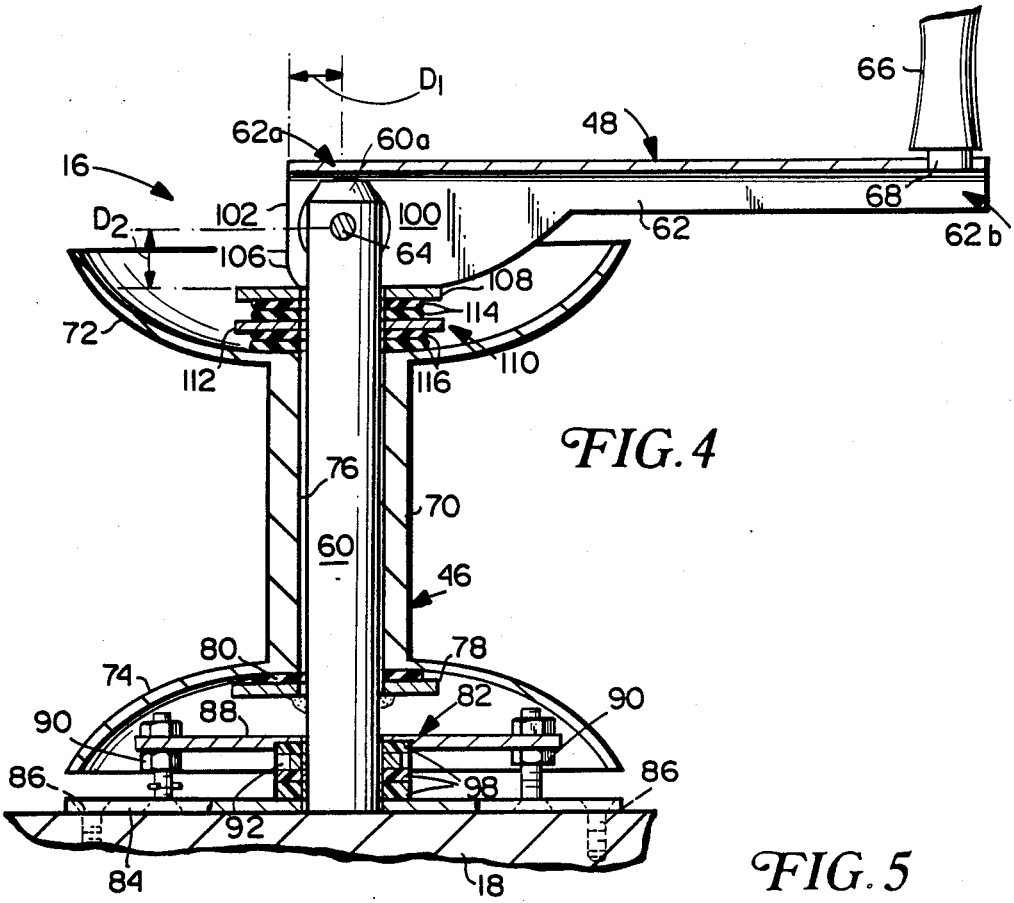
FIG. 4
FIG. 5
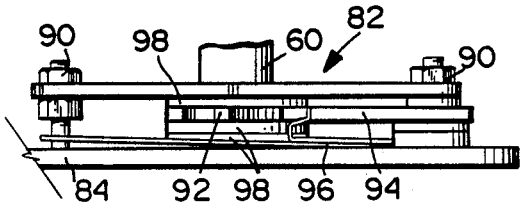
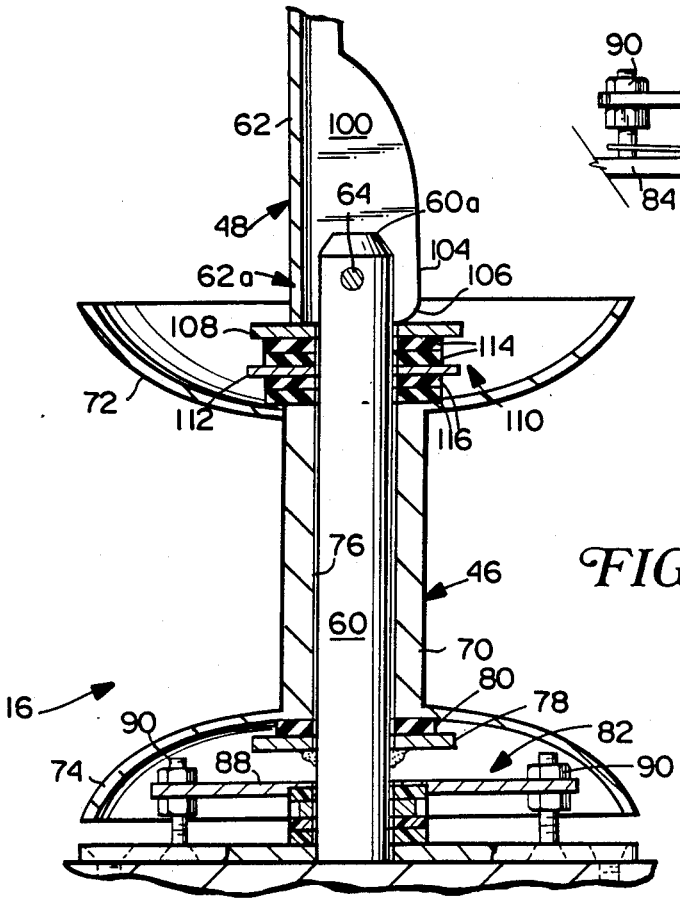
FIG. 3

ANCHOR DAVIT ASSEMBLIES

FIELD OF THE INVENTION

This invention is generally related to the field of marine crafts having anchors which are stowed onboard during periods of nonuse (e.g., during movement of the craft on water, portage of the craft, etcetera). In a particularly preferred form, the present invention is embodied in an improved anchor davit assembly having an anchor support bracket, a winch assembly, and releasable locking means associated with the bracket and/or hoist so as to lock the anchor in its stowed position.

BACKGROUND AND SUMMARY OF THE INVENTION

In my prior U.S. Pat. No. 3,804,051 issued Apr. 16, 1974 and entitled "Anchor Adapter Bracket" (the entire content of this prior patent being expressly incorporated hereinto by reference), there is disclosed a novel anchor support bracket having a pair of anchor support surfaces and a pair of resilient pads that maintain the anchor, when raised, in a substantially horizontal position. Although the anchor adapter bracket disclosed in my prior U.S. Pat. No. 3,804,051 solved several practical problems associated with the stowage and transport of marine craft anchors, some improvements were still needed.

For example, in the anchor support bracket of my prior U.S. Pat. No. 3,804,051, the anchor is locked in its horizontal position via a rigid safety pin extending through the anchor's eye and slidably supported at each of its ends via the anchor support sidewalls. While such a rigid safety pin locking system does, in fact, provide reliable locking of the anchor/anchor bracket during periods of anchor stowage, a problem exists that the pin may bend or otherwise distort due to forcible shocks it may receive when the marine craft is in transit across water swells or during portage of the craft, for example. Any bending or distortion of the rigid safety pin renders it difficult to remove when the anchor is again desired to be set — a situation which may present an inconvenience to the boater at best and, at worst, may prevent the anchorage of the marine craft due to the anchor being "frozen" in place via the bent and/or distorted safety pin.

According to one particularly important aspect of this invention, however, a releasable locking assembly is provided which overcomes the problems associated with the rigid safety pin system disclosed in my prior U.S. Pat. No. 3,804,051. Preferably, the releasable locking assembly is embodied in an "over-the-center" spring system which includes a manually actuated lever pivotally connected to one of the lateral support members of the anchor bracket so as to the capable of pivotal movements between unlocked and locked positions.

A tension spring (or other suitable biasing means) has one end connected to the leaver at a pivot point located rearwardly of the lever's pivot connection to the lateral support member. The other end of the tension spring is configured, for example, in the form of a hook, so as to be capable of connection to the anchor's tail.

With the tension spring connected to the anchor's tail, the lever may then be pivoted into its locked position which, in turn, causes the tension spring to expand and thereby exert a bias force on the anchor rearwardly against its support structure associated with the anchor bracket. Moreover, once the lever has been pivoted towards its locked position a sufficient amount so that the bias force vector exerted by the tension spring lies below the pivot point of the lever (i.e., below the lever's pivot connection to the lateral support member of the anchor bracket), the tension spring will serve the additional beneficial function of biasing the lever in a direction which tends to cause it to pivot into its locked position. This pivotal biasing of the lever thereby assures that, even should shock forces of abnormal magnitude be experienced during movement of the marine craft over the water or during portage, the lever will be maintained in its locked position until the boater manually pivots it against the bias force of the spring when the anchor is again desired to be set.

It will be realized that once the bias force vector lies above the leaver's pivot point (i.e., above the leaver's pivot connection to the lateral support of the anchor bracket, the lever will then be biased into its unlocked position (i.e., in a pivot direction opposite to that exerted upon the lever when the bias force vector lies below the lever pivot point) thereby assisting the boater in removing the anchor from its locked relationship with the anchor bracket.

Another advantageous feature of the present invention is that a novel winch is provided which may be used in operative combination with the anchor bracket so as to provide a complete anchor davit assembly. The winch of this invention will, however, find other uses in marine and non-marine environments where a load is desired to be manually winched. According the winch of this invention, a spool is rotatably mounted to an axle. A line, cable, chain or the like which is connected to the load (which, in the context of an anchor davit assembly, is the anchor itself) may thus be wound and unwound from the spool in dependance upon the load being hoisted or lowered, respectively. A manyally actuated handle is pivotally coupled at one of its ends to a distal end of the axle.

The handle defines at its pivoted end a suitable cam profile which operates to force a friction member against the spool as the handle is pivoted from its released position (in which the friction member minimally, if at all, frictionally engages the spool and thus permits the spool to freely rotate around the axle) and an engaged position (in which the cam member forces for friction member into frictional engagement with the spool and thus, in essence, establishes a substantially rigid connection between the handle and the spool). It will be appreciated that, with the handle in its engaged position, the handle and spool may be rotated as a unit so as to hoist the anchor (or other load to which the line is attached). Also, the cam surface may be caused to apply greater/lesser force against the friction member in dependance upon the handle member being in a position intermediate its released and engaged positions. This capability permits the boater (or winch operator) to allow the line to pay out at lesser/greater rates, respectively, and thus maintain control over the descending load.

The advantages mentioned above, and others will become more clear to the reader after careful consideration is given to the detailed description of the preferred exemplary embodiments thereof which follow.

BRIEF DESCRIPTION OF THE ACCOMPANYING DRAWINGS

Reference will hereinafter be made to the following accompany drawings depicting particularly preferred embodiments of this invention in which like reference numerals throughout the various FIGURES denote like structural elements, and wherein:

FIG. 1 is a prespective view of an anchor davit assembly according to this invention and shown in position relative to a marine craft;

FIG. 2*a* and 2*b* collectively show the manner in which the locking assembly associated with the anchor support bracket is operated;

FIG. 3 is a cross-sectional view of the winch according to this invention and particularly showing the manually operated handle thereof in its released position;

FIG. 4 is a cross-sectional view of the winch according to this invention similar to the view provided by FIG. 3, but showing the handle in its engaged position;

FIG. 5 is a partial elevation view particularly showing the ratchet assembly and axle bearings employed in this invention.

DETAILED DESCRIPTION OF THE PREFERRED EXEMPLARY EMBODIMENTS

Figure 1:
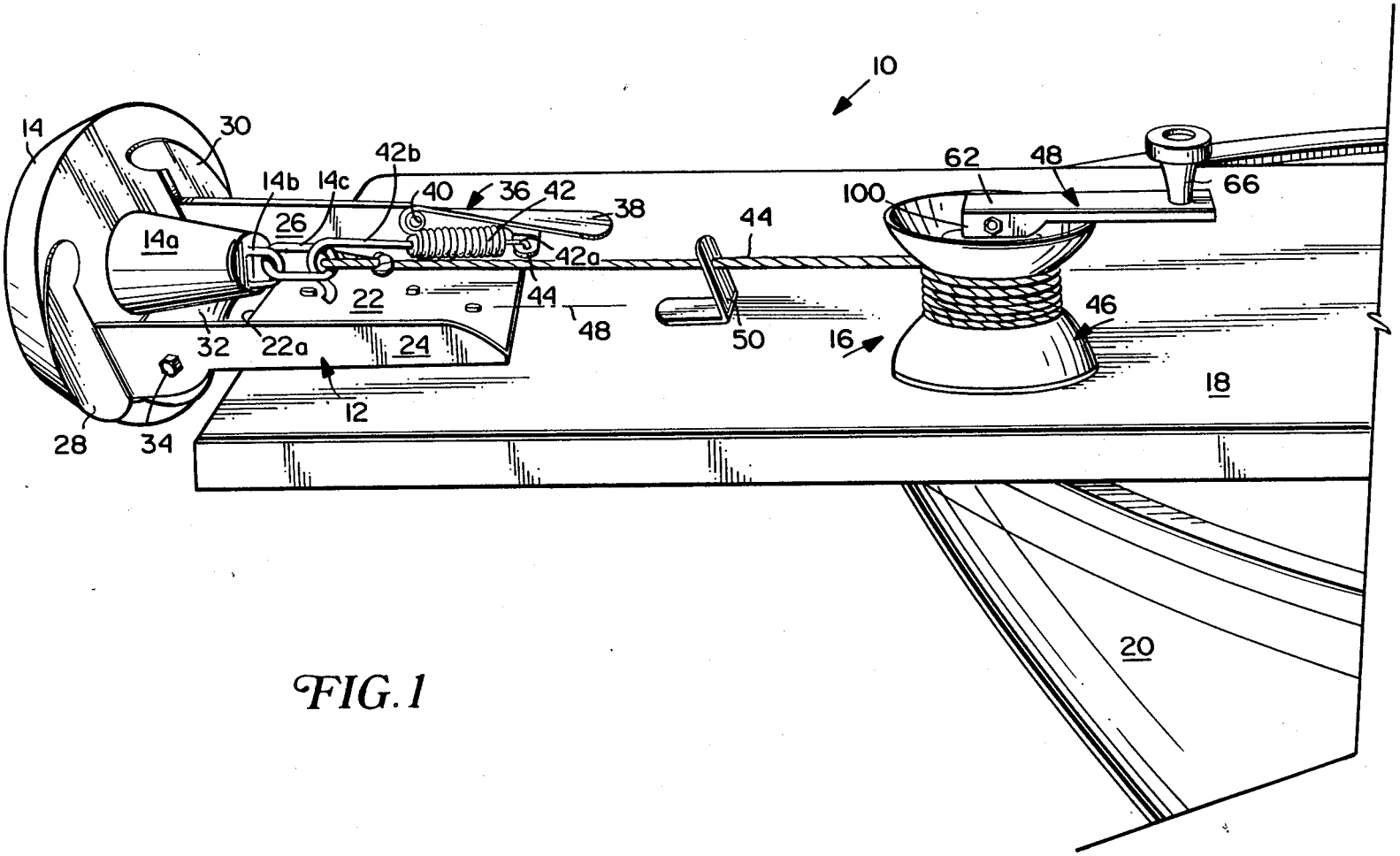

A preferred embodiment of the anchor davit assembly is shown in accompanying FIG. 1 and includes an anchor support bracket 12 which supports an anchor 14, and a winch 16 positioned rearwardly of the bracket 12. The anchor davit assembly of this invention just happens to be shown mounted in relation to a bow plank 18 of a marine craft (a portion of which is visible in FIG. 1 at reference numeral 20). Obviously, the anchor davit assembly 10 could be mounted to the craft 20 in any convenient location where the assembly 10 is capable of performing its intended functions (as will be discussed in greater detail below).

The anchor bracket 12 is preferably a one-piece structure fabricated from marine grade material (e.g., stainless steel). The bracket 12 will thus preferably have a base support plate 22 and a pair of lateral support plates 24 and 26, respectively. A pair of forward support plates 28, 30 are rigid with a respective one of the lateral support plates 24, 26 and collectively provide a forward surface (not shown in FIG. 1) against which the anchor 14 bears when it is in its stowed position (i.e., as is shown in FIG. 1).

It will be noticed that the lateral support plates 24, 26 each extend forwardly of the base support plate 22 so as to establish a space in which a support roller 32 is mounted. That is, the support roller 32 spans the distance between the lateral support plates 24, 26 forwardly of the leading edge 22*a* of the base plate 22. The support roller is preferably of the type having a concave roller surface and is mounted for rotation relative to the lateral support plates 24, 26 via roller axle 34. The roller support 32 thus serves to support the tail 14*a* of the anchor 14 when it is in its stowed position as shown.

The bracket 12 also includes a releasable locking assembly 36 generally comprised of a lever 38 pivotally connected at pivot point 40 to the lateral support plate 26 and a tension spring member 42. One end 42*a* of spring member 42 is connected to inwardly turned mounting flange 44 associated with the lever 38 while the other end 42*b* of spring member 42 is configured (e.g., in the form of a hook so as to be removably engaged with the anchor (e.g., with the anchor eye 14*b* or a ring 14*c* connected to the anchor eye).

The winch 16 is mounted rearwardly of the anchor bracket 12 and is connected to the anchor 14 via a line 44, a portion of which is wound around the spool 46 or winch 16. A handle assembly 48 is provided so as to allow the line to be wound upon, and unwound from the spool 46 in a manner to be described late. The center of the winch 16 is referably offset relative to the center-line 48 of the anchor support bracket 12 so that the line 44 is substantially tangential to the spool 46 and thus aligned substantially with the center-line 48. A line guide 50 may be interposed between the anchor bracket 12 and the winch 16 so as to assist the guiding of the line 44 to and from the spool 46.

Figure 2A:
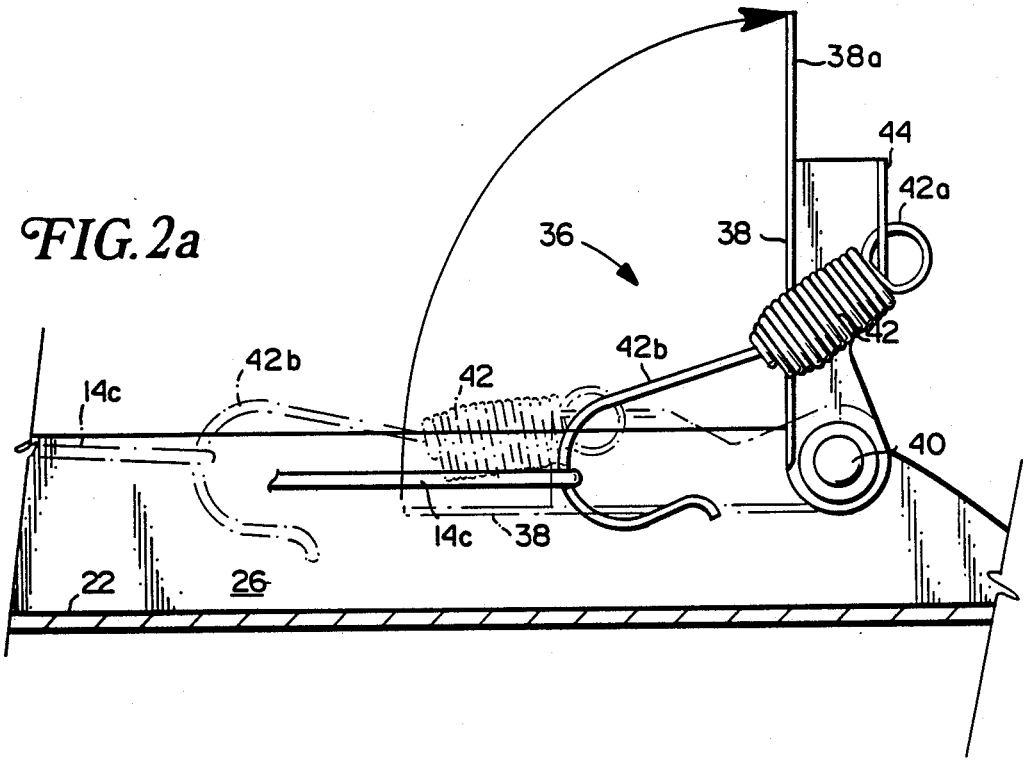
Figure 2B:
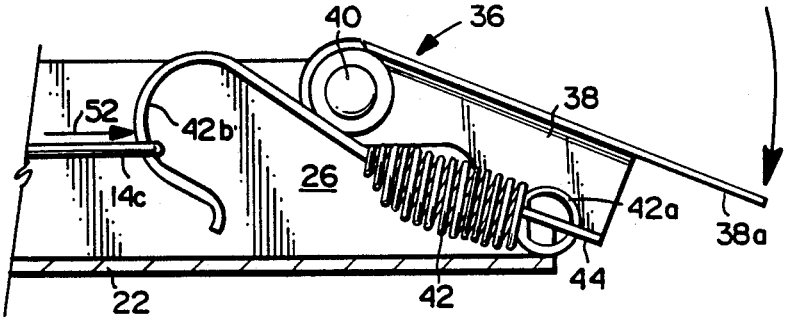

The releasable locking assembly 36 which is preferably employed according to this invention is shown in greater detail in accompanying FIGS. 2*a* and 2*b*. In FIG. 2*a*, the locking assembly 36 is shown in an "unlocked" position. It will be noted that rotation of the lever about pivot point 40 in the counterclockwise direction (as viewed in FIG. 2*a*) will allow the hook end 42*b* of the spring member 42 to be advanced towards the anchor eye 14*b* or its attached ring 14*c* (only the ring 14*c* being shown in FIGS. 2*a* and 2*b* for clarity of presentation). Thus, with the terminal end 38*a* of lever 38 is directed forwardly (i.e., towards the anchor 14), the hook end 42*b* of spring member 42 will be moved in close proximity to the ring 14*c* so that the boater may easily engage the two structures. This state is shown in chain line in FIG. 2*a*.

Once the hook end 42*b* of spring member 42 and the ring 14*c* (or anchor eye 14*b*) of the anchor 14 have been engaged, the boater will manually pivot the lever 38 in the clockwise direction towards its "locked" position as shown by the arrow in FIG. 2*a*. It will be noted here that during pivotal movement of the lever 38 towards its locked position, the ring 14*c*, and hence the anchor 14, will be pulled rearwardly until the anchor 14 contacts the forward surfaces of the forward supports 28 and 30 (see, FIG. 1). After the anchor 14 is in contact with the forward supports 28, 30, any continued pivotal movement of the lever 38 in the clockwise direction will cause the spring member 42 to expand thereby exerting a rearwardly directed bias force upon the anchor 14 and thus encourage the same to remain in contact with the forward supports 28, 30.

Continued pivotal movement of the lever 38 towards its locked position (i.e., in a clockwise direction as viewed in FIG. 2*a*) will continue to cause the spring member 42 to expand as was mentioned briefly above. When the spring member 42 is at a position below the pivot point 40, its bias force will encourage the lever member 38 to pivot in the clockwise direction. This pivotal encouragement provided by the spring member 42 thus not only assists the boater in moving the lever into its locked position (i.e., as is shown in FIG. 2*b*), but also resists pivotal movement of the lever member 38 in the counterclockwise direction as viewed in FIG. 2*b*. Thus, the spring member 42 collectively biases the anchor 14 rearwardly (arrow 52 in FIG. 2*b*) and maintains the lever 38 in its locked position.

Of course, when it is desired to unlock the anchor 14, the boater simply exerts sufficient force on lever 38 in the counterclockwise direction to overcome the clockwise pivotal bias provided by the spring member 42. Continued pivotal movement of the lever 38 in a counterclockwise direction to a position as shown in FIG. 2a — that is, with the spring member 42, and hence its bias force vector, above the pivot 40 — will then tend to cause the lever 38 to pivot in a counterclockwise direction. This tendency of the spring member 42 when in the position shown in FIG. 2a thus assists the boater in releasing the locking engagement between the locking assembly 36 and the anchor 14 since the lever will be encouraged to pivot into its unlocked position once the spring member is positioned above the pivot point 40.

Figure 6:
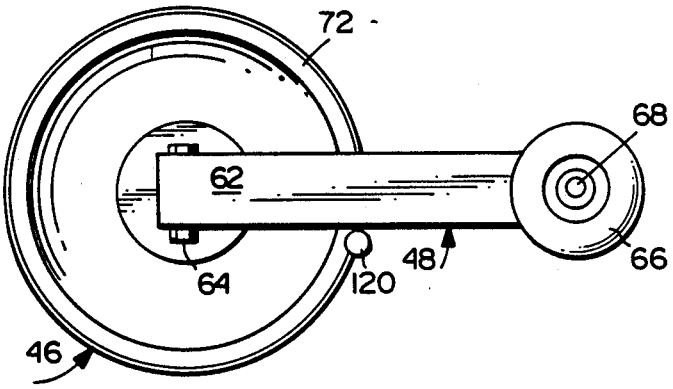
FIG. 6 is a tip plan view of the winch shown in FIGS. 3 and 4.

The winch 16 of this invention is shown in greater detail in accompanying FIGS. 4–6. The reader will undoubtedly appreciate that, although the winch 16 has been, and will hereinafter be, described in connectin with its use in the anchor davit assembly 10, it may find other beneficial uses in marine or non-marine environments. Thus, the winch 16 of this invention may be used alone in virtually any environment in which a load is desired to be hoisted and lowered.

Winch 16 is generally comprised of a spool 46, an axle 60 about which the spool is capable of freely rotating (as will be described later), and a handle subassembly 48. The handle subassembly 48 includes a handle lever 62 pivotally connected at its end 62a to the distal end 60a of axle 60 via pivot pin 64. At its other end 62b, the handle lever 62 is provided with a graspable handle 66, itself mounted for rotation about a handle axle 68 (see FIG. 4). The handle subassembly 48 is thus mounted for pivotal movements relative to axle 60 between the positions shown in FIGS. 3 and 4 (which positions will be later referred to as the "released" and "engaged" positions, respectively, of the handle subassembly 48).

The spool 46 is itself preferably a one-piece structure provided with a central spool core 70 and a pair of end flanges 72 and 74. The end flanges 72, 74 are preferably cup-shaped (i.e., outwardly flared relative to the spool core 70) so as to assist in the winding/unwinding of line 44 (not shown in FIGS. 3 and 4, but see FIG. 1) relative to spool core 70. The flanges 72, 74 could just as easily be planar without departing from the present invention, however.

The spool core 70 defines a central opening 76 which is sized and configured to slip over the axle 60 with sufficient clearance provided such that the spool core 70, and hence the entire spool 46, is capable of freely rotating thereabout. Mounting of the spool 46 to permit such relative movement is accomplished by a support ring 78 rigidly coupled to the axle 60 (as by soldering, welding, etcetera) adjacent the spool end flange 74. A friction washer 80 which is preferably formed of a compressible elastomeric material is positioned between the support ring 78 and the spool end flange 74, the purpose of which will be described later. The spool core 70 is therefore positionally retained between the handle end 62a and the support ring 78 with a slight amount of axial play.

The axle 60 is itself mounted for rotation via the mounting subassembly 82. As is seen in FIGS. 3–5, the subassembly 82 is generally comprised of a base plate 84 which is adapted to being rigidly secured to an underlying support structure (for example bow plank 18) via screws 86. A bearing plate 88 is rigidly spaced from the base plate 84 via bolt and nut sets 90. In the space established between the base and bearing plates 84 and 90, respectively, a ratchet wheel 92 is provided and is rigidly coupled to the axle 60. The ratchet wheel coacts with a pawl 94 (see FIG. 5) so as to permit rotation of the ratchet wheel 92, and hence the axle 60, in only one direction as is per se well known. The pawl 94 thus is pivotally connected to one of the nut and bolt sets 90 and is biased into engagement with the teeth of the ratchet wheel 92 via a torsion spring 96.

The ratchet wheel is captured between bushings 98 which are preferably of the self-lubricating variety (e.g., nylon). The bushings positionally retain the ratchet wheel 92, and hence the axle 60 to which it is rigidly attached, and also provide bearing surfaces during its pivotal movements.

Referring again specifically to accompanying FIGS. 3 and 4, it will be observed that the end 62a of handle lever 62 is provided with a cam lobe 100. In the preferred embodiment illustrated, the handle lever 62 is in the form of an inverted "U" as viewed in latitudinal cross-section. Thus, in practice, it is preferred that a pair of lobes 100 be provided. For purposes of understanding this invention, however, a discussion of only one of the lobes 100 will suffice, it being understood that such discussion is equally applicable to the other of the lobes 100.

The cam lobe 100 defines at least first and second cam surfaces 102 and 104, respectively, which are joined by an arcuate transition surface 106. The surfaces 102 and 104 are shown as being planar but could be convexly arcuate, for example, without departing from the present invention. It will be noted in FIG. 4 that the pivot pin 64 is eccentric with respect to the surfaces 102 and 104 such that dimensions $D_1$ and $D_2$ are defined between the pivot pin 64 and the surface 102 and 104, respectively, with dimension $D_1$ being less compared to dimension $D_2$.

The surfaces 102, 104 and 106 cooperate with an upper rigid bearing ring 108 associated with the clutch subassembly 110. It is preferred that the clutch subassembly be comprised of a pair of rigid bearing rings 108 and 112 as shown with pairs of friction members 114, 116 (preferably formed of a compressible elastomeric material) interposed therebetween and between bearing ring 112 and the spool end flange 72, respectively. However, more or less bearing rings and friction members may be provided according to the invention in dependance upon may factors, including the overall size of the winch 16 and/or the weight of the load which it is rated to hoist, to name just a few.

While the handle assembly is in its released position (i.e., as is shown in FIG. 3), the friction members 80, 114, and 116 will minimally (if at all) frictionally engage the spool 46. Thus, if the friction members are formed on a compressible elastomeric material, they will be in a "relaxed" state when the handle subassembly 48 is in its released position due to the cam surface 102 with its attendant lesser dimension $D_1$ being disposed adjacent the bearing ring 108. In this condition, the spool 46 is allowed to freely rotate about the axle 60.

However, when the handle subassembly 48 is pivoted to its engaged position as shown in FIG. 4, the cam surface 104 with its attendant larger dimension $D_2$ is then brought into bearing contact with the bearing ring 108. The friction members 114 and 116 are therefore reponsively caused to frictionally engage bearing ring 112 and the spool end flange 72, respectively, while at the same time, the spool end flange 74 is brought into frictional engagement with the friction member 80 (i.e., since slight axial play is provided as between the spool core 70 and the axle 60). Thus, if the friction members 80, 114 and/or 116 are formed of a compressible material (i.e., an elastomer), then they will be in a compressed state while the handle subassembly 48 is in its engaged position thereby exerting the requisite frictional engagement against the spool 46 as described.

The effect of the handle subassembly 48 being in its engaged position is that the spool 46 and axle 60 are temporarily substantially rigidly united. Thus, rotation of the axle 60 via the handle subassembly 48 will also cause the spool 46 to concurrently rotate in the one-way direction permitted by the ratchet wheel 92 and pawl 94. In this manner, the load (e.g., anchor 14) may be hoisted by rotation of the handle subassembly 48.

It will, of course, be appreciated, that the union effected by means of the clutch assembly 110 described above is not prefectly rigid. Thus, relative slippage may occur as between the spool 46 and axle 60 if the load upon the line 44 is such that it exceeds the friction forces imparted to the spool via the clutch assembly 110 and friction member 80, as may occur when the anchor 14 is snagged in underwater debris, rocks, etcetera.

To positively ensure that the anchor may be hoisted via the winch 16, the spool end flange 72 is provided with a limit stop 120 extending upwardly therefrom a sufficient dimension so as to engage the handle lever 62 (see FIG. 6). Thus, in the event that relative slippage occurs between the spool 46 and the axle 60, it will be limited by the eventual engagement of the limit stop 120 with the handle lever 62. In normal circumstances for the particular load capacity of the winch 16, however, the friction forces exerted upon the spool via the clutch subassembly 110 and/or friction member 80 will be sufficient to prevent relative slippage between the spool 46 and axle 60 so that they may be rotated as a unit.

In use, the anchor 14 is released from its locked relationship with the anchor bracket 12 by pivoting the lever 38 of the locking subassembly 36 in a counterclockwise direction as viewed in FIGS. 2*a* and 2*b* until the hook end 42*b* of the spring member 42 is capable of being disengaged from the ring 14*c* and/or the anchor eye 14*b*. In this condition, the anchor 14 is ready to be lowered into the water. The boater will then man the winch 16, and will move the handle subassembly 48 from its engaged position (as shown in FIG. 3) to its released position (as shown in FIG. 4). The weight of the anchor 14 will thus pull on the line 44 and, since the spool 46 is capable of free rotation about the axle 60 with the handle subassembly 48 in its released position, the line 44 will be payed out from the spool 46 thereby allowing the anchor 14 to descend into the water.

The rate at which the line 44 is payed out is controlled by the boater moving and holding the handle subassembly 48 to position(s) intermediate of its released and engaged positions — particularly positions defined along the arc of the transition surface 106 associated with cam lobe 100. As will be appreciated from the discussion above with respect to the winch 16, by holding the handle subassembly 46 at positions intermediate its released and engaged positions, greater/lesser friction force will be exerted upon the spool 46 so as to responsively retard/increase the pay out rate of the line 44, respectively.

Rate control of line pay out is particularly convenient if the boater maintains the handle subassembly 46 in one of the many intermediate positions allowed by the arcuate transition surface 106 of cam lobe 100. That is, by maintaining bearing contact between the surface 106 and the bearing ring 108, the boater may quickly adjust the line pay out between a minimum rate (i.e., by positioning the handle assembly so that the bearing ring 108 bears against the surface 106 near its intersection with surface 104) and a maximum rate (i.e., by positioning the handle assembly so that the bearing ring 108 bears against the surface 106 near its intersection with surface 102). By varying the relative position of the handle subassembly between these two extremes, the rate of line pay out may be satisfactorily controlled.

When the anchor 14 has descended to a desired water depth, the boater will move the handle subassembly fully into its engaged position as shown in FIG. 4 to arrest the anchor's further descent. Here, it will be noted that should the anchor become snagged upon underwater debris, rocks or the like, some relative slippage between the spool 46 and the axle 60 might occur. However, when the limit stop 120 contacts the handle lever 62, continued relative slippage between the spool 46 and axle 60 is prevented (thereby preventing continued undesired line pay out from the spool 46). Interengagement between the limit stop 120 and the handle lever 62 thereby provides "true" rigid coupling of the spool 46 and axle 60 through the interengaged ratchet wheel 92 and pawl 94.

While the handle subassmbly 48 is in its engaged position, the boater may then rotate axle 60, and hence the spool 46 due to the rigid coupling between the spool 46 and axle 60 via the clutch subassembly 110 and/or the limit stop 120 and handle lever 62 interengagement. This pivotal movement, in turn, is in a direction allowed by the ratchet wheel 92 and pawl 94 (i.e., in a clockwise direction as viewed from above FIG. 1) so as to hoist the anchor. When the anchor has been hoisted upon the support roller 32, the locking subassembly 36 may again be set as was described in connection with FIGS. 2*a* and 2*b*.

The present invention is not limited to a manually operated anchor davit assembly. To the contrary, it is entirely conceivably that the lever 38 and/or handle subassembly 46 may be pivoted between their extreme positions by any suitable actuator (e.g., electric motors, pneumatic or hydraulic actuators, etcetera). Thus, for large marine vessels requiring a concomitantly large (and heavy) anchor, it may be more desirable to embody the invention in an anchor davit assembly having such actuators.

Therefore, while the invention has been described in connection with what is presently considered to be the most practical and preferred embodiment, it is to be understood that the invention is not to be limited to the disclosed embodiment. Instead, the present invention is intended to cover various modifications and equivalent arrangements included within the spirit and scope of the appended claims.

What I claim is:

1. An anchor davit assembly comprising:

an anchor support bracket for supporting an anchor in a stowed position and including a base support member, a pair of lateral support members rigid with said base support member, and a forward support member rigid with at least said pair of lateral support members and defining a surface against which a portion of the anchor is supported;

said anchor support bracket including releasable locking means connectable to the anchor for releasably locking the same in its said stowed position, said releasable locking means including, (a) a lever, (b) connection means for pivotally connecting said lever to at least one of said lateral support members to permit pivotal movements of said lever between locked and unlocked positions, and (c) biasing means having one end connected to said lever rearwardly of said connection means and another end adapted to being removably interconnected to said anchor, said biasing means for resiliently urging said anchor rearwardly against said defined surface of said forward support member when said lever is in said locked position, and for encouraging said lever to pivot in one and another opposite directions in dependance upon said biasing means being on one and another sides, respectively, of said connection means.

2. An anchor davit assembly as in claim 1, further comprising winch means having a line attachable to the anchor for hoisting and lowering the anchor.

3. An anchor davit assembly as in claim 2, wherein said winch means includes;

an axle having one end adapted to being rigidly connected to a supporting surface;

a spool rotatably connected to said axle;

a handle pivotally connected at one end thereof to the other end of said axle so as to be capable of pivotal movements between released and engaged positions about an established pivot axis; and control means in operative association with said spool and acted upon by said handle for (i) allowing said spool freely rotate about said axle when said handle is in said released position, whereby said anchor is lowered, and (ii) effecting a substantially rigid connection between said handle and said spool when said handle is in said engaged position, whereby said spool and handle may be rotated as a unit to hoist the anchor.

4. An anchor davit assembly as in claim 3, wherein said control means includes;

friction means operatively positioned between said spool and said handle one end; and cam means defining a cam surface at said handle one end for engaging said friction means to greater and lesser extents in response to said handle being moved towards said engaged and released positions, respectively, said friction means responsively frictionally engaging said spool to respective greater and lesser extents, whereby the rate at which said anchor is lowered may be controlled.

5. An anchor davit assembly as in claim 4, wherein said cam means is provided collectively by first and second bearing surfaces which are spaced from said established pivot axis by greater and lesser radial dimensions, respectively.

6. An anchor davit as in claim 4, wherein said friction means includes a compressible friction member.

7. An anchor davit as in claim 3, wherein said spool further includes a position stop member which contacts said handle when said handle is in said engaged position.

8. An anchor davit as in claim 3, wherein said winch means further includes ratchet means for allowing said spool to be rotated only in one direction when said handle is in said engaged position.

9. In an anchor davit assembly of the type including an anchor support bracket for supporting an anchor in a stowed position, the improvement wherein said anchor support bracket includes:

support means which defines a forward support surface against which a portion of said anchor bears when in said stowed position thereof; and releasable locking means operatively associated with said support means for releasably locking said anchor to said anchor support bracket and for urging said anchor poriton into bearing contact against said forward support surface of said support means, said locking means including;

a lever;

connection means for pivotally connecting said lever to said anchor support bracket so as to permit pivotal movements to said lever between locked and unlocked positions, and biasing means having one end connected to said lever rearwardly of said connection means and another end adapted to being removably interconnected to said anchor rearwardly of said forward support surface of said support means, said biasing means for (i) resiliently urging said anchor rearwardly to cause said anchor portion to be brought into bearing contact against said forward support surface of said support means of said anchor support bracket when said lever is in said locked position, and (ii) encouraging said lever to pivot in a direction towards said locked position.

10. In an anchor davit as in claim 9, the improvement further comprising winch means having a line attachable to the anchor for hoisting and lowering the anchor.

11. In an anchor davit assembly as in claim 10, the improvement wherein said winch means includes;

an axle having one end adapted to being rigidly connected to a supporting surface;

a spool rotatably connected to said axle;

a handle pivotally connected at one end thereof to the other end of said axle so as to be capable of pivotal movements between released and engaged positions about an established pivot axis; and control means in operative association with said spool and acted upon by said handle for (i) allowing said spool to freely rotate about said axle when said handle is in said released position, whereby said anchor is lowered, and (ii) effecting a substantially rigid connection between said handle and said spool when said handle is in said engaged position, whereby said spool and handle may be rotated as a unit to hoist the anchor.

12. In an anchor davit assembly as in claim 11, the improvement wherein said control means includes;

friction means operatively positioned between said spool and said handle one end; and cam means defining a cam surface at said handle one end for engaging said friction means to greater and lesser extents in response to said handle being moved towards said engaged and released positions, respectively, said friction means responsively frictionally engaging said spool to respective greater and lesser extents, whereby the rate at which said anchor is lowered may be controlled.

13. In an anchor davit assembly as in claim 12, the improvement wherein said cam means is provided collectively by first and second bearing surfaces which are spaced from said established pivot axis by greater and lesser radial dimensions, respectively.

14. In an anchor davit assembly as in claim 12, the improvement wherein said friction means includes a compressible friction member.

15. In an anchor davit assembly as in claim 11, the improvement wherein said spool further includes a position stop member which contacts said handle when said handle is in said engaged position.

16. In an anchor davit assembly as in claim 11, the improvement further including ratchet means for allowing said spool to be rotated only in one direction when said handle is in said engaged position.

17. A winch comprising:

an axle;

a spool freely rotatable about said axle;

a handle pivotally connected at one end thereof to an end of said axle so as to capable of pivotal movements between released and engaged positions about an established pivot axis; and control means in operative association with said spool and acted upon by said handle for (i) allowig said spool to freely rotate about said axle when said handle is in said released position, whereby a load may be lowered, and (ii) effecting a substantially rigid frictional union between said handle and said spool when said handle is in said engaged position, whereby said spool and handle may be rotated as a unit to hoist the load, wherein said spool includes stop means for limiting an extent of forced rotation thereof about said axle, said stop means having a stop member rigidly associated with said spool and adapted to contact said handle in said engaged position, whereby to extent of forced rotation of said spool about said axle is limited by means of contact between said stop member and said handle.

18. A winch as in claim 17, wherein said control means includes;

friction means operatively positioned between said spool and said handle one end; and cam means defining a cam surface at said handle one end for engaging said friction means to greater and lesser extents in response to said handle being moved towards said engaged and released positions, respectively, said friction means responsively frictionally engaging said spool to respective greater and lesser extents, whereby the rate at which said anchor is lowered may be controlled.

19. A winch as in claim 18, wherein said cam means is provided collectively by first and second bearing surfaces which are spaced from established said pivot axis by greater and lesser radial dimensions, respectively.

20. A winch as in claim 18, wherein said friction means includes a compressible friction member.

21. A winch as in claim 17, wherein said spool further includes a position stop member which contacts said handle when said handle is in said engaged position.

22. A winch as in claim 17, the improvement further including ratchet means for allowing said spool to be rotated only in one predetermined direction when said handle is in said engaged position.

23. An improved winch for hoisting and lowering a load connected to the winch via a line, said winch comprising:

a spool having a spool core and a pair of opposing spool end flanges, the line being wound upon said spool core between said end flanges;

an axle;

means for mounting said spool to said axle to allow free pivotal movements of said spool thereabout;

base means adapted to being rigidly connected to a supporting surface and including bearing means for mounting said axle to allow for pivotal movements of said axle relative to said base means;

a handle;

means for pivotally connecting said handle to an end of said axle to establish a pivot axis thereof and to allow for pivotal movements of said handle between released and engaged positions;

friction clutch means actuable to provide an inoperative condition which allows said free rotation of said spool about said axle, and an operative condition which effects a substantially rigid frictional union between said spool and said axle so that said spool and axle are rotatable as a unit relative to said base means; and cam means associated with said handle for causing said clutch means to assume said inoperative and operative conditions in response to said handle being pivotally moved into said released and engaged positions, respectively, wherein said cam means includes;

(i) first and second cam surfaces defined on said handle which respectively establish said released and engaged positions thereof;

(ii) said first and second cam surfaces being eccentrically disposed to said established pivot axis such that said first surface is radially separated from said pivot axis by a lesser dimension as compared to a radial separation dimension between said second surface and said pivot axis; and (iii) a convexly arcuate transition surface joining said first and second cam surfaces for establishing a number of intermediate positions of said handle between said released and engaged positions thereof to responsively cause said clutch means to frictionally engage said spool to greater and lesser extents when said handle is in one and another of said intermediate positions thereof which, in turn, allows lowering of said load under its own weight at lesser and greater rates, respectively, whereby said load may be paid out under a controlled rate.

24. An improved winch as in claim 23, wherein said friction clutch means includes;

a rigid clutch plate associated with said axle and which provides a bearing surface for said cam means; and at least one friction member disposed between said clutch plate and that one of said end flanges of said spool adjacent said handle, wherein pivotal movment of said handle into said engaged position causes said cam means to bear against said bearing surface of said clutch plate and to, in turn cause said friction member to frictionally engage said one end flange, whereby said substantially rigid union between said spool and said axle is effected.

25. An improved winch as in claim 24, wherein said friction clutch means further includes another friction member fixed to said axle and against which the other of said end flanges is brought into frictional engagement in response to said handle being pivotally moved into said engaged position.

26. An improved winch as in claim 25, wherein said another friction member includes a support plate rigid with said axle, said another friction member being disposed between said support plate and said another end flange.

27. An improved winch as in claim 25, wherein said another friction member is comprised of a compressible elastomeric material.

28. An improved winch as in claim 24, wherein said friction member is comprised of a compressible elastomeric material.

29. An improved winch as in claim 23, further comprising ratchet means for allowing said spool and said axle to rotate in only one predetermined direction when said handle is in said engaged position.

30. An improved winch as in claim 23, further comprising stop means for limiting an extent of forced rotation of said spool about said axle against said operative condition of said clutch means.

31. An improved winch for hoisting and lowering a load connected to the winch via a line, said winch comprising:

a spool having a spool core and a pair of opposing spool end flanges, the line being wound upon said spool core between said end flanges;

an axle;

means for mounting said spool to said axle to allow free pivotal movements of said spool thereabout;

base means adapted to being rigidly connected to a supporting surface and including bearing means for mounting said axle to allow for pivotal movements of said axle relative to said base means;

a handle pivotally connected to an end of said axle for pivotal movments between released and engaged positions;

clutch means actuable to provide an inoperative condition which allows said free rotation of said spool about said axle, and an operative condition which effects a substantially rigid union between said spool and said axle so that said spool and axle are rotatable as a unit relative to said base means;

cam means associated with said handle for causing said clutch means to assume said inoperative and operative conditions in responds to said handle being pivotally moved into said released and engaged positions, respectively; and stop means for limiting an extent of forced rotation of said spool about said axle against said operative condition of said clutch means, wherein said stop means includes a stop member extending rigidly from that one of said end flanges adjacent said handle, said stop member contacting said handle when said handle is in said engaged position, whereby the extent of forced rotation of said spool about said axle is limited.

* * * * *